US006645003B2

(12) United States Patent
Yoshida et al.

(10) Patent No.: US 6,645,003 B2
(45) Date of Patent: Nov. 11, 2003

(54) JOINT CONNECTOR

(75) Inventors: Haruki Yoshida, Shizuoka (JP); Toshiyuki Yamaguchi, Shizuoka (JP); Masaaki Ikegaya, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/075,766

(22) Filed: Feb. 15, 2002

(65) Prior Publication Data

US 2002/0115355 A1 Aug. 22, 2002

(30) Foreign Application Priority Data

Feb. 16, 2001 (JP) ..... 2001-040071

(51) Int. Cl.[7] ..... H01R 31/08
(52) U.S. Cl. ..... 439/507; 439/701; 439/862
(58) Field of Search ..... 439/701, 862, 439/507, 721, 908, 101, 251, 949, 66, 595, 513

(56) References Cited

U.S. PATENT DOCUMENTS 3,324,445 A * 6/1967 Miller ..... 439/66
3,541,222 A * 11/1970 Parks et al. ..... 439/66
3,796,986 A * 3/1974 Tamburro ..... 439/66
5,556,301 A * 9/1996 Chishima et al. ..... 439/507
5,791,934 A * 8/1998 Hatley et al. ..... 439/66
6,097,609 A * 8/2000 Kabadi ..... 439/66

FOREIGN PATENT DOCUMENTS

EP 0601 538 A2 * 6/1994 ..... 439/507
JP 2-5288 1/1990
JP 6-52953 * 2/1994 ..... 439/507
JP 2000-150055 5/2000

* cited by examiner

*Primary Examiner*—Tho D. Ta
(74) *Attorney, Agent, or Firm*—Sughrue Mion, PLLC

(57) ABSTRACT

A joint connector includes housings which can be stacked together, with a predetermined gap formed therebetween, each of the housings having a plurality of juxtaposed terminals received therein, and a circuit forming element which is inserted into the gap between the stacked housings, and connects arbitrarily-selected ones of the terminals in the adjacent housings, adjoining to each other in a stacking direction, and also connects arbitrarily-selected ones of the terminals in the same housing. By inserting the circuit forming element, the connection of the terminals can be effected easily, and besides a desired circuit can be easily obtained by the circuit structure of the circuit forming element.

15 Claims, 15 Drawing Sheets

JOINT CONNECTOR

CROSS REFERENCE TO RELATED APPLICATION

The present application is based on Japanese Patent Application No. 2001-40071, the entire contents of which are incorporated herein by reference.

BACKGROUND OF THE INVENTION

1. Field of the Invention

This invention relates to a joint connector in which housings, each receiving a plurality of terminals therein, can be stacked together in such a manner that their terminals are connected.

2. Related Art

One conventional joint connector is disclosed, for example, in JP-A-2000-150055. In this joint connector, as shown in FIG. 17, a metal connection terminal member 4, comprising a plurality of terminal units 3 connected by a carrier 2, is attached to each of housings 1 which can be stacked together in an upward-downward direction. Connection inserting pieces 5 of the terminal units 3 project from a bottom of the housing 1, and the terminal unit 3 has a pair of connection spring pieces 6 between which the connection inserting piece 5 can be inserted.

Therefore, arbitrary portions of the carriers 2, as well as arbitrary ones of the connection inserting pieces 5, are cut off, and the housings 1 are stacked one upon another, and these cut-off portions serve as non-conducting portions, and therefore various circuit patterns can be formed. One example of such circuit patterns is a connection structure shown in FIG. 18. In this circuit pattern, the horizontally-connecting relation (indicated by straight lines) between the terminal units 3, indicated respectively by circles in vertically-arranged two rows of rectangular sections (each row represents one housing 1), is determined by the cutting and uncutting of the carriers 2 of the horizontally-arranged terminal units 3, and the vertically (stacking direction)-connecting relation (indicated by straight lines) between the terminal units 3 is determined by the cutting and uncutting of the connection inserting pieces 5.

However, in this conventional joint connector, the relevant portions of the carriers 2 in the horizontal direction remain in an uncut condition, and by doing so, there is formed a circuit in which each of groups of adjoining terminal units 3 (that is, the terminal units c and d and the terminal units f to i in the row A, and the terminal units d and e and the terminal units f to i in the row B) are connected together as shown in the circuit pattern of FIG. 18. The relevant connection inserting pieces 5 remain in an uncut condition, and by doing so, there is formed the circuit in which each of pairs of upper and lower stacked terminal units 3 in the rows A and B (that is, the terminal units in the column a, the terminal units in the column L and the terminal units in the column j) are connected together.

However, once the horizontally-disposed carrier 2 is cut intermediate the columns a to j, the right and left groups, separated from each other by this cut portion, are rendered into a non-conducting condition relative to each other. Therefore, it is impossible to connect the terminal units of each of the rows A and B in a skipped manner, with one or two terminal units interposed therebetween, and for example in the connection structure of FIG. 18, the terminal units a and j in the row A can not be connected together, and the formation of the circuit is much limited.

SUMMARY OF THE INVENTION

Therefore, this invention has been made in view of the above problem of the prior art, and an object of the invention is to provide a joint connector which enables terminals, disposed in a stacked condition, to be easily connected together, and besides enables a wide variety of circuit formation patterns including a skip connection.

(1) There is provided a joint connector comprising: at least two housings which are stacked together with a predetermined gap formed therebetween, each of the housings having a plurality of juxtaposed terminals received therein; and a circuit forming element provided in the gap, by which arbitrary ones of the terminals are selectively connected with others of the terminal in the housings adjoining to each other as well as in the same housing.

In this case, by inserting the circuit forming element into the gap between the stacked housings, arbitrarily-selected ones of the terminals of the adjacent housings, adjoining to each other in the stacking direction, can be connected by this circuit forming element, and also the arbitrarily-selected ones of the terminals in the same housing can be connected by this circuit forming element. Therefore, with the simple construction in which the circuit forming element, separate from the terminals, is inserted into the gap, the terminals, disposed in a stacked manner, can be easily connected, and besides the desired circuit can be easily obtained by the circuit structure of the separate circuit forming element.

(2) There is provided a joint connector according to (1), wherein one of the housings is divided into at least two sub-housings, each of which is releasably engaged with another sub-housing, and the sub-housings respectively accommodate a predetermined number of the terminals, so that the plurality of terminals in the one housing are divided with a predetermined ratio.

Therefore, in the case where groups of wires for connection to the terminals are installed from different directions, the groups of wires are beforehand connected respectively to the separate housings corresponding respectively to these wire groups, and the separate housings, when stacked on another housing, are combined together into a unitary form, and by doing so, the wire-connecting operation can be effected easily.

(3) There is provided a joint connector according to (1), further comprising insertion ports formed on a fitting portion of the housing, wherein mating terminals in a mated connector are connected respectively to the terminals through the insertion ports when the mating connector is fitted into the fitting portion.

In this case, arbitrary circuits are formed by the plurality of terminals received in the stacked housings, and then the mating connector is fitted on the fitting portion of the joint connector, and by doing so, the mating terminals of the mating connector, forming other wiring circuits, can be easily connected to the terminals, respectively.

(4) There is provided a joint connector according to (2), wherein an engaging portion formed on one of the sub-housings serves as a positioning device by which arrangement pitches of the terminals between the sub-housings are coincided in an engaging direction of the sub-housing.

In this case, except at the engaging portion, the terminals, received in the housing, are disposed respectively in registry with the terminals in the adjoining housing in the stacking direction, and therefore the combination of the circuits (formed by inserting the circuit forming element) in the stacking direction can be made clear.

(5) There is provided a joint connector according to (1), wherein the circuit forming element includes a bus bar provided with a conductor member, and a bus bar-fixing member provided with an insulating member, and the bus bar and the bus bar-fixing member are integrally coupled with each other.

In this case, the bus bar is supported on the bus bar-fixing member, and therefore the bus bar can be held in contact with the terminals without the need for excessively increasing the strength of this bus bar.

(6) There is provided a joint connector according to (5), wherein the bus bar includes a plurality of pairs of terminal contact pieces, each pair of which are brought into contact respectively with the terminals opposing with each other provided in the housings adjoining to each other in the stacking direction, a pair of connecting base portions one of which integrally connects proximal ends of the terminal contact pieces disposed at one side while the other connecting base portion integrally connects proximal ends of the terminal contact pieces disposed at the other side, and connecting pieces connecting the pair of connecting base portions.

In this case, with respect to the pairs of terminal contact pieces connected to the terminals of the adjacent housings, each group of terminal contact pieces are electrically connected together by the corresponding connecting base portion, and the two connecting base portions are electrically connected together through the connecting pieces. Therefore, in this condition, the terminal contact piece, contacted with the specified terminal, is electrically connected through one connecting base portion to the other terminal contact pieces, connected to this connecting base portion, and also is connected to the other connecting base portion through the connecting piece, and is further connected to the terminal contact pieces (provided in paired relation to the first-mentioned terminal contact pieces) through this connecting base portion, and as a result all of the terminal contact pieces are electrically connected together. In this condition, one or both of the pair of connecting base portions are cut at suitable portions, and suitable ones of the connecting pieces are cut, and by doing so, a wide variety of circuits, including a skip connection, can be formed.

(7) There is provided a joint connector according to (6), wherein the pair of connecting base portions are offset with respect to each other so that the two connecting base portions do not overlap each other in a plane of projection in a direction of opposing of the connecting base portions to each other.

In this case, when cutting suitable portions of the pair of connecting base portions by inserting cutting blades respectively in their opposing directions, these connecting base portions can be easily cut separately from each other since the two connecting base portions are offset with respect to each other.

(8) There is provided a joint connector according to (6), wherein the proximal ends of the terminal contact pieces are integrally attached to the bus bar-fixing member.

In this case, the terminal contact pieces are fixed at their proximal ends to the bus bar-fixing member, and therefore each of the terminal contact pieces can secure the force of contact with the terminal, effectively utilizing its spring force.

(9) There is provided a joint connector according to (5), wherein an opening is formed on the bus bar, and a projection having a flange is formed on the bus bar-fixing member, and the projection is fitted in the opening in such a manner that a gap is formed partially between the projection and an inner peripheral surface of the opening, and the bus bar and the bus bar-fixing member are coupled together through the opening and the projection.

In this case, when the flange of the projection on the bus bar-fixing member is deformed upon fitting of the projection into the opening in the bus bar, such a deformed portion escapes to the gap, and therefore the amount of cutting of the flange by the inner peripheral surface of the opening can be decreased.

(10) There is provided a joint connector according to (6), wherein cutting portions are selectively formed on the bus bar in the vicinity of portions where the connecting base portion and the connecting piece are connected together.

In this case, the connecting base portion and the connecting piece are cut in the vicinity of the connecting portion where these are connected together, and therefore these cut portions are provided in a concentrated manner, so that the electrically-connecting relation can be easily controlled, and besides cutting blades for the connecting base portions and the connecting pieces can be arranged in a concentrated manner.

(11) There is provided a joint connector according to (1), wherein a retaining projection is formed on one of the housings, the retaining projection being inserted into a terminal accommodating portion formed on another of the housing adjoining to the one housing in stacked relation, and the retaining projection retain the terminal received in the terminal accommodating portion in a direction to prevent the withdrawal of the terminal.

In this case, the retaining projection is engaged with the terminal, thereby preventing the withdrawal of the terminal more positively.

(12) There is provided a joint connector according to (11), wherein a lance for engaging the terminal in a direction to prevent the withdrawal thereof is provided in the terminal accommodating portion of the housing, and the bus bar-fixing member has a lance-return regulating portion pressing the lance in a withdrawal prevention direction.

In this case, when the circuit forming element is inserted into the gap between the stacked housings, this lance-return regulating portion presses the lance in the withdrawal prevention direction, and therefore the restoration of the lance and hence the cancellation of its engagement with the terminal are prevented.

(13) There is provided a joint connector according to (6), wherein a chamfered portion is formed at an opposite side edge of the terminal contact piece brought into contact with the terminal.

In this case, when the terminal contact piece is brought into contact with the terminal with its predetermined resilient force, the terminal is prevented from being damaged by the side edges of the contact portion of the terminal contact piece.

(14) There is provided a joint connector according to (6), wherein the connecting piece has a U-shaped bent portion turned back in a U-shaped manner at a side edge of the bus bar-fixing member, and the U-shaped bent portion is exposed to a fitting portion fitted into a mating connector.

In this case, the U-shaped bent portions of the connecting pieces are exposed to the fitting portion of the housings, and therefore, a measuring terminal of a tester can be easily brought into contact with these exposed portions, and therefore the conducting relation of the bus bar can be examined easily and positively. And besides, the exposed U-shaped bent portions are disposed at the fitting portion on which the mating connector is fitted, and therefore when the mating connector is fitted, the exposed portions can be concealed.

DETAILED DESCRIPTION OF THE PREFERRED EMBODIMENTS

A preferred embodiment of the present invention will now be described in detail with reference to the accompanying drawings. FIGS. 1 to 11 show one preferred embodiment of a joint connector of the invention.

Figure 1:
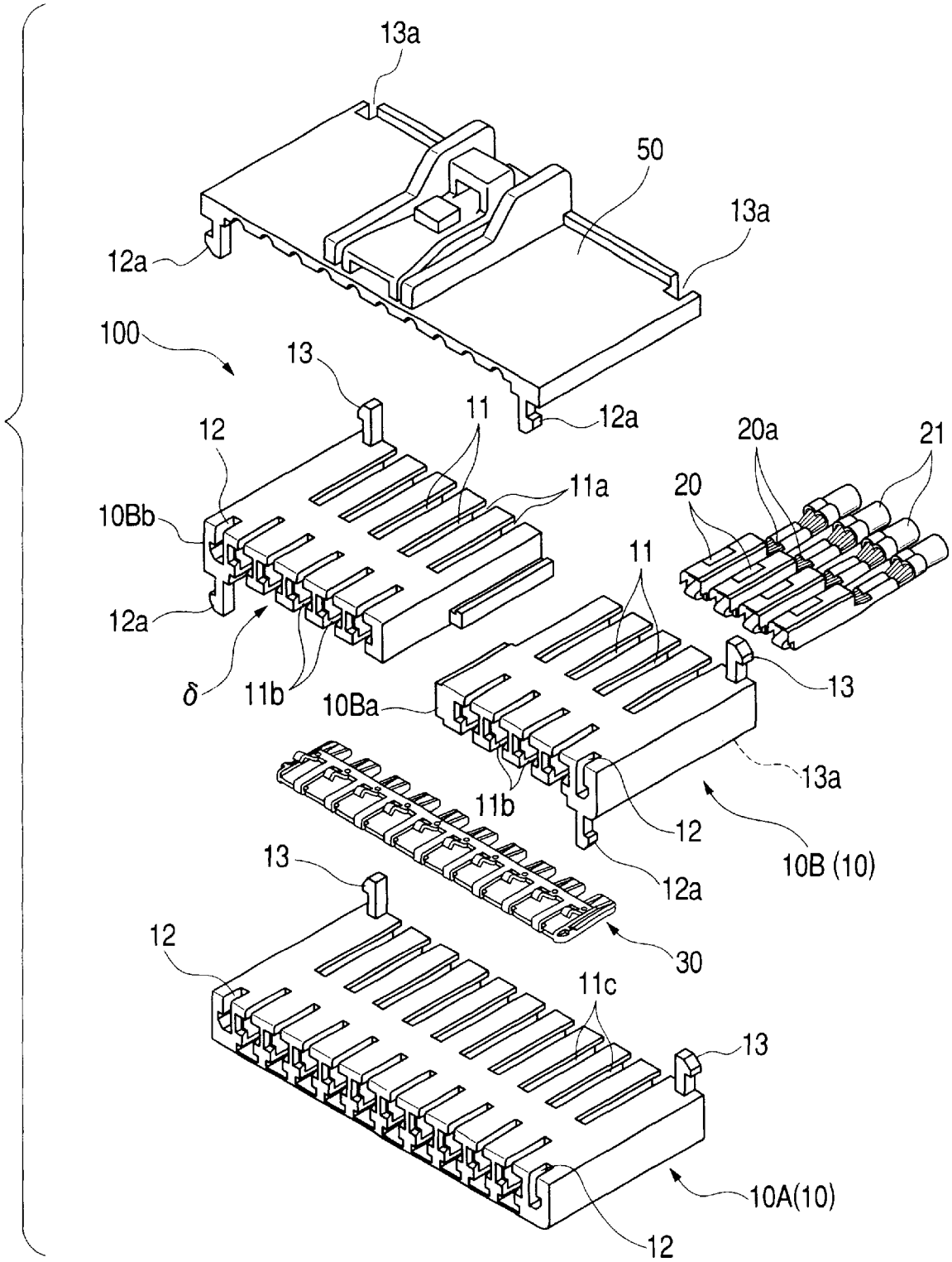
FIG. 1 is an exploded, perspective view of one preferred embodiment of a joint connector of the present invention.

FIG. 1 is an exploded, perspective view of the joint connector 100, and this joint connector 100 comprises housings 10, terminals 20, a circuit forming element 30, and a cover 50. Terminal accommodating portions 11 for respectively receiving the plurality of terminals 20 are formed in a juxtaposed manner at the housing 10. Each of these terminal accommodating portions 11 has an inserting port 11*a* (for the terminal 20), formed in a rear surface (rear side in the drawings) of the housing 10, and also has an insertion port 11*b* (into which a mating terminal 220, described later, can be inserted) formed in a front surface (front side in the drawings) of the housing 10. A front end portion of each of the terminals 20, connected at its rear end to a wire 21, can be inserted into the terminal accommodating portion 11 through the inserting port 11*a*.

Figure 2:
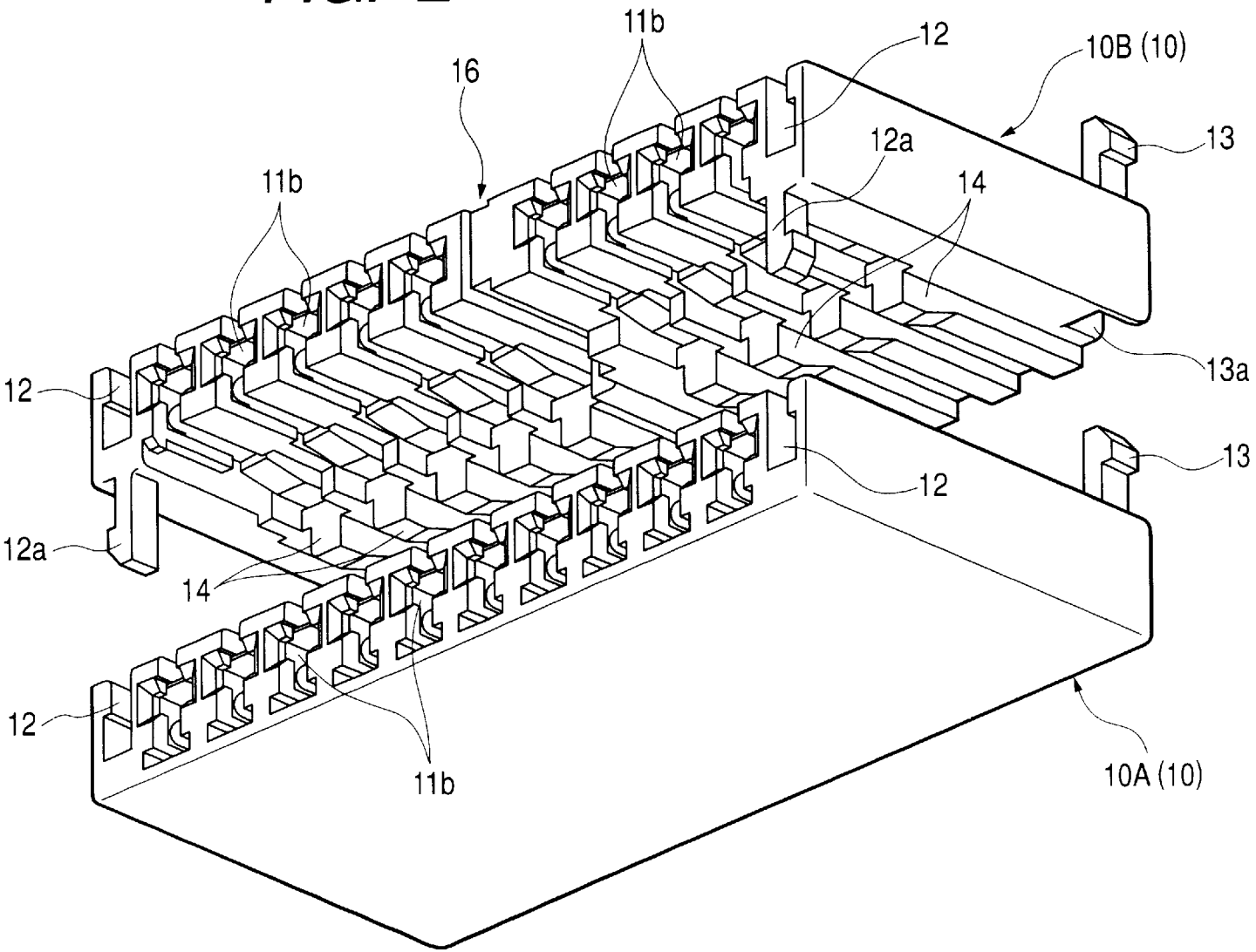
FIG. 2 is a perspective view of the embodiment of the joint connector of the invention, showing a condition before housings are stacked together.
Figure 3:
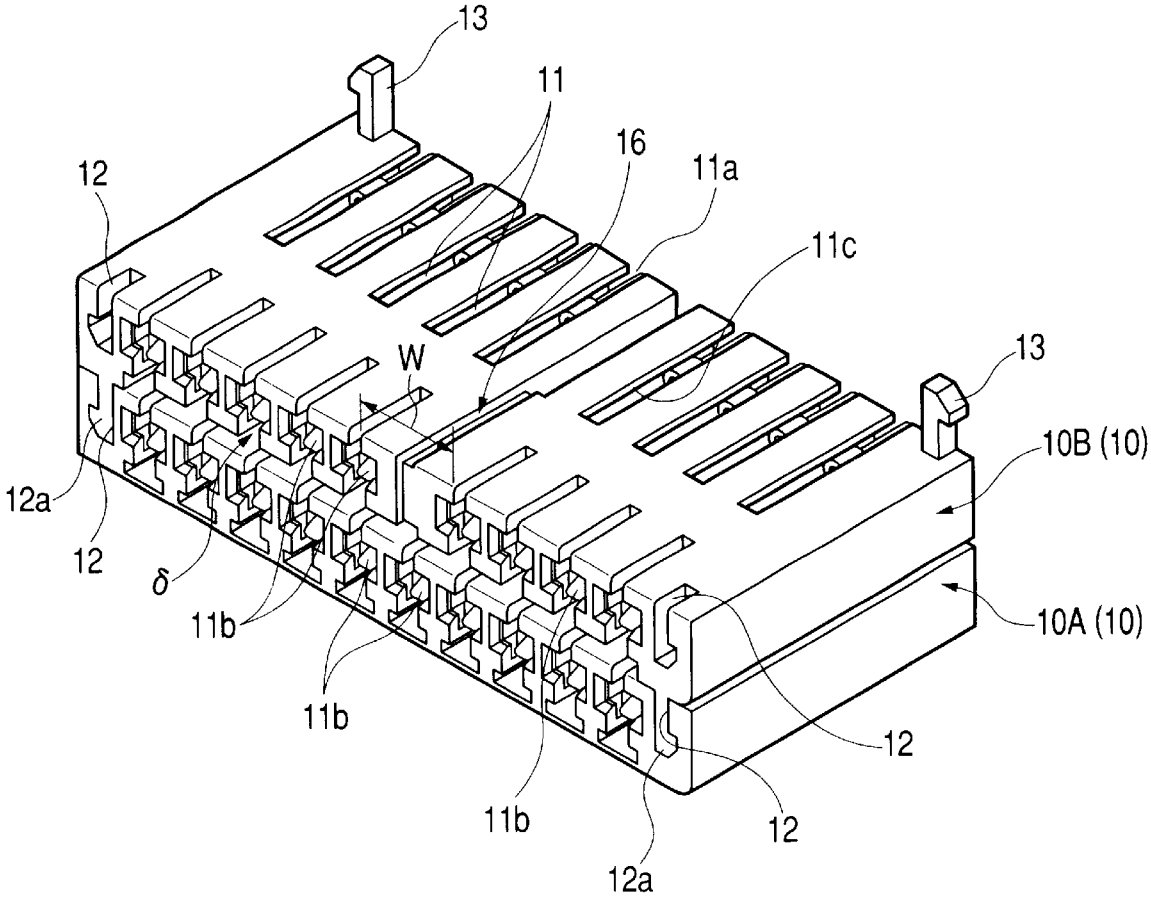
FIG. 3 is a perspective view of the embodiment of the joint connector of the invention, showing a condition in which the housings are stacked together.

As shown in FIG. 2 which is a perspective view showing a condition before the stacking, first engagement recesses 12 are formed respectively in opposite side portions of an upper surface of the housing 10 at the front side thereof, and first engagement projections 13 are formed respectively on the opposite side portions of the upper surface of the housing at the rear side thereof. Second engagement projections 12*a* are formed respectively on opposite side portions of a lower surface of the housing 10 at the front side thereof, and second engagement recesses 13*a* are formed respectively in the opposite side portions of the lower surface of the housing 10 at the rear side thereof. The first engagement recesses 12 of one housing 10, disposed at the lower side (in the drawings), are fitted respectively on the second engagement projections 12*a* of the other housing 10, disposed at the upper side (in the drawings), and also the first engagement projections 13 of the one housing 10 are fitted respectively in the second engagement recesses 13*a* of the other housing 10, and by doing so, the plurality of housings 10 can be stacked one upon another as shown in FIG. 3 which is a perspective view showing the stacked condition. In this embodiment, the second engagement projections 12*a* and 12*a* and the second engagement recesses 13*a* and 13*a* are not provided at the lower surface of that housing 10 which is to be disposed at the lowermost position.

The terminal accommodating portions 11 of all of the housings 10 are arranged at the same pitch, and when the plurality of housings 10 are stacked one upon another, the inserting ports 11*a* of the terminal accommodating portions 11 of the vertically-stacked housings 10, as well as the insertion ports 11*b* of these terminal accommodating portions 11, are disposed in vertically-registered relation.

Figure 4:
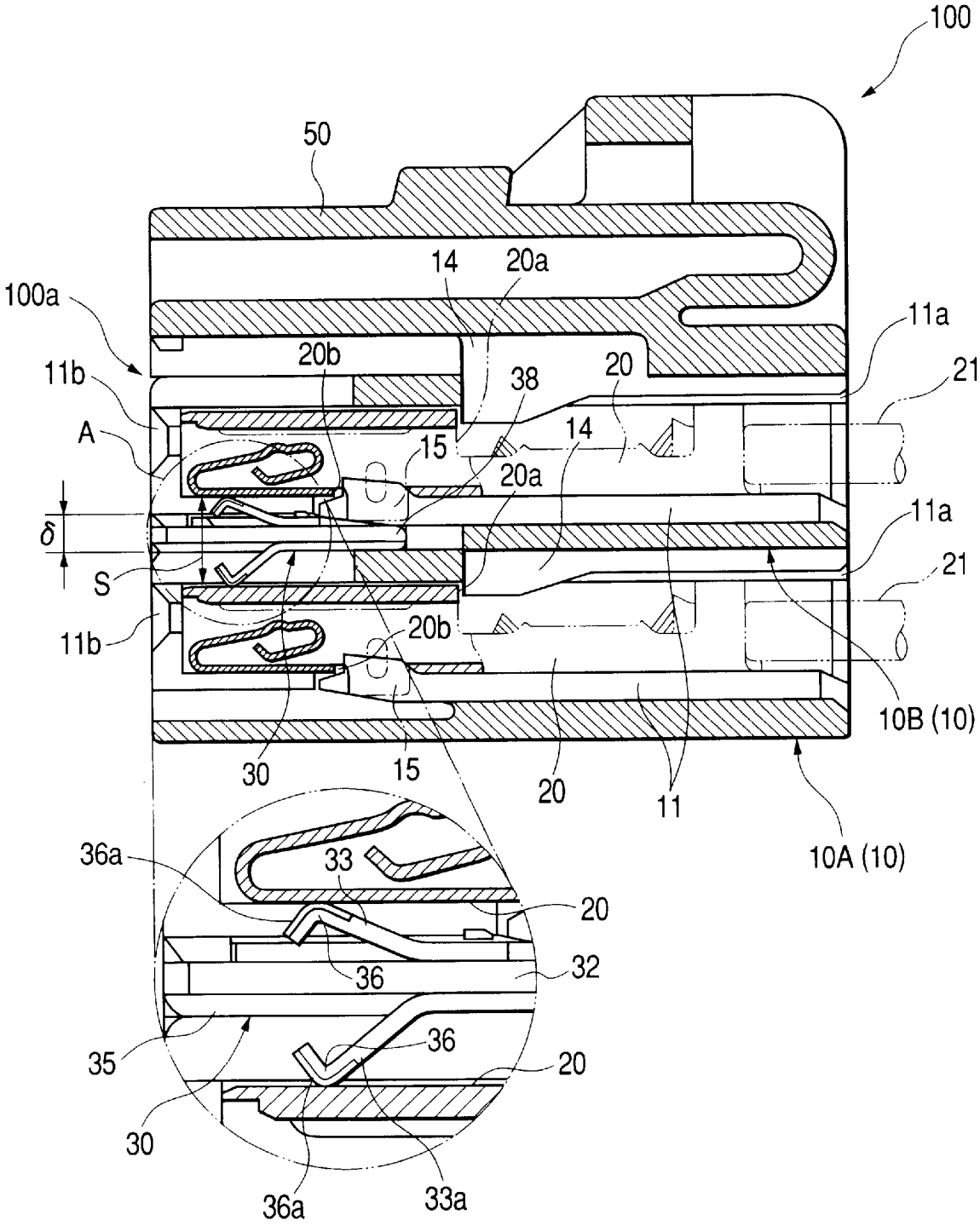
FIG. 4 is a vertical cross-sectional view of the embodiment of the joint connector of the invention.

FIG. 4 is a cross-sectional view showing the two housings 10 stacked together, and retaining projections 14 are formed on the lower surface of the upper housing 10, and these retaining projections 14 are inserted respectively into the terminal accommodating portions 11 of the lower housing 10 (on which the upper housing 10 is laid) through respective slots 11*c* formed respectively in upper walls of these terminal accommodating portions 11. On the other hand, each terminal 20 has a retaining recess 20*a*, and the retaining projection 14 is retainingly engaged in this retaining recess 20*a* in the terminal 20, received in the terminal accommodating portion 11, thereby preventing the withdrawal of the terminal.

As shown in FIG. 4, a lance 15 is provided at a lower portion of the terminal accommodating portion 11, and this lance 15 engages a retaining portion 20*b* of the terminal 20 to prevent the withdrawal of the terminal 20. This lance 15 and the retaining projection 14 form a double-retaining structure for retaining the terminal 20.

The cover 50 is attached to the upper side of the vertically-stacked housings 10 and 10 (FIG. 3) as shown in FIG. 1. Second engagement projections 12*a* and 12*a* and second engagement recesses 13*a* and 13*a* as described above are provided at a lower surface of this cover 50, and are fitted relative to the first engagement recesses 12 and 12 and the first engagement projections 13 and 13 of the uppermost one of the stacked housings 10.

Figure 5:
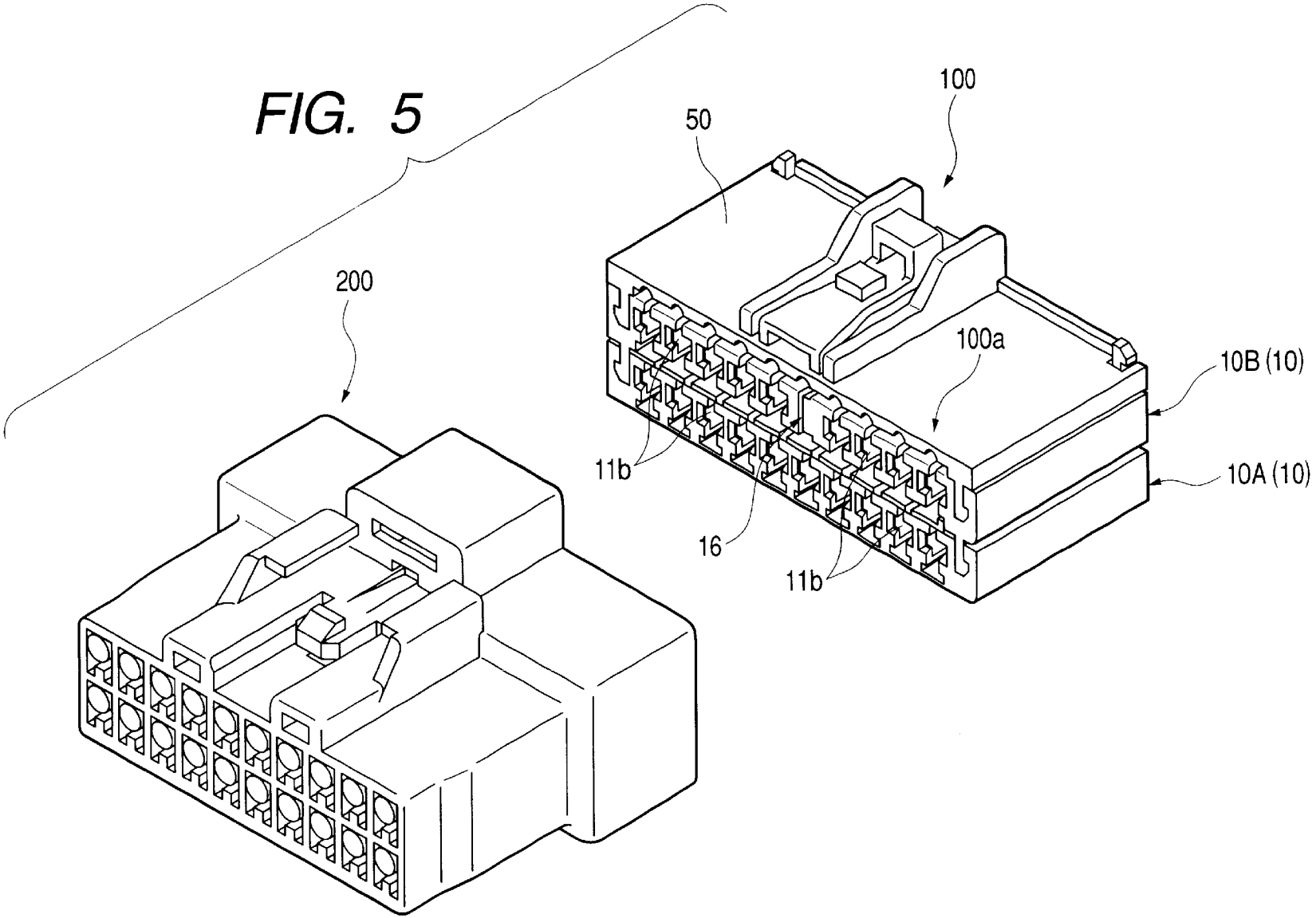
FIG. 5 is a perspective view showing the joint connector of the invention an a mating connector for connection thereto.
Figure 6:
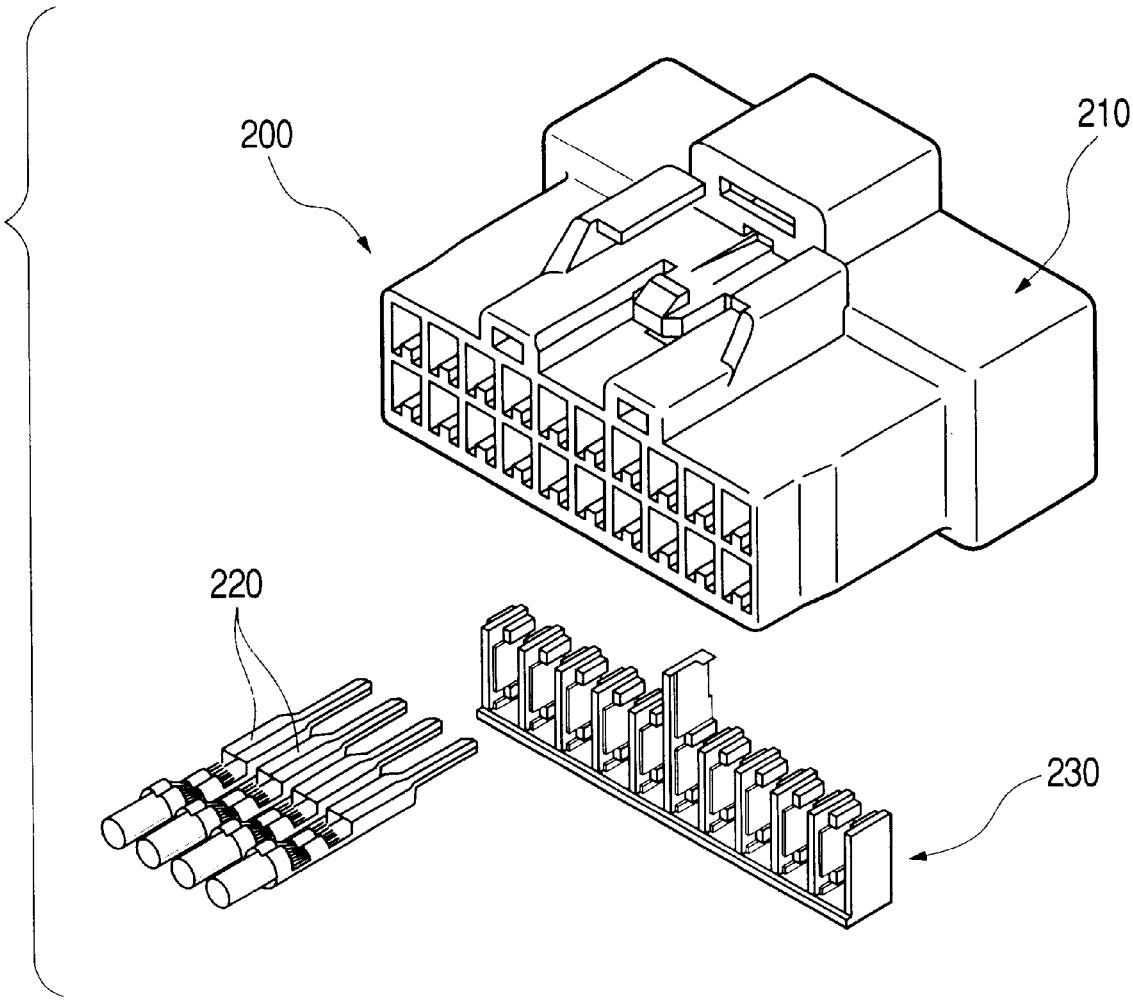
FIG. 6 is an exploded, perspective view of the mating connector for connection to the joint connector of the invention.

In this manner, the housings 10 and 10 and the cover 50 are stacked together to form the joint connector 100, and as shown in FIG. 5 (which is a perspective view), a front end portion of this joint connector 100 serves as a fitting portion 100*a* for fitting into a mating connector 200. Therefore, the insertion ports 11*b* of the terminal accommodating portions 11 are arranged neatly at the distal end surface of this fitting portion 100*a*.

As shown in FIG. 1, the lower one of the stacked housings 10 and 10 is the housing 10A of the integrated type while the upper one is the split-type housing 10B. The split-type housing 10B is divided into two (right and left) sub-housings such that the plurality of terminals 20, received therein (that is, the terminal accommodating portions 11), are divided in the suitable ratio. These housing portions 10B*a* and 10B*b*, separate from each other, are releasably connected together into a unitary form through an engaging portion 16.

As shown in FIG. 3, a width W of the engaging portion 16 is determined in view of the pitch of the terminal accommodating portions 11, and this engaging portion 16 serves as a positioning device by which the arrangement pitch of the terminal accommodating portions 11 of the upper housing 10A except this engaging portion 16 coincides with the arrangement pitch of the terminal accommodating portions 11 of the lower housing 10A.

As shown in FIG. 4, a gap δ for inserting the circuit forming element 30 therein is formed between the front surfaces of the stacked housings 10 and 10. The circuit forming element 30, inserted into this gap δ, is disposed between the upper and lower groups of terminals 20, received respectively in the housings 10 and 10, and are held in contact with these terminals 20, and therefore are electrically connected thereto. The detailed structure of this circuit forming element 30 will be described later with reference to FIGS. 7 to 10.

On the other hand, the mating connector 200 broadly comprises a housing 210 for fitting on the fitting portion 100*a* of the joint connector 100 to cover the same, the plurality of mating terminals 220 received in this housing 210, and a spacer 230 provided within the housing 210 to hold the mating terminals 220, 220.

When the mating connector 200 is fitted on the fitting portion 100*a* of the joint connector 100, the mating terminals 220 are inserted into the respective insertion ports 11*a* in the joint connector 100, and are connected to the corresponding terminals 20, respectively.

Figure 7:
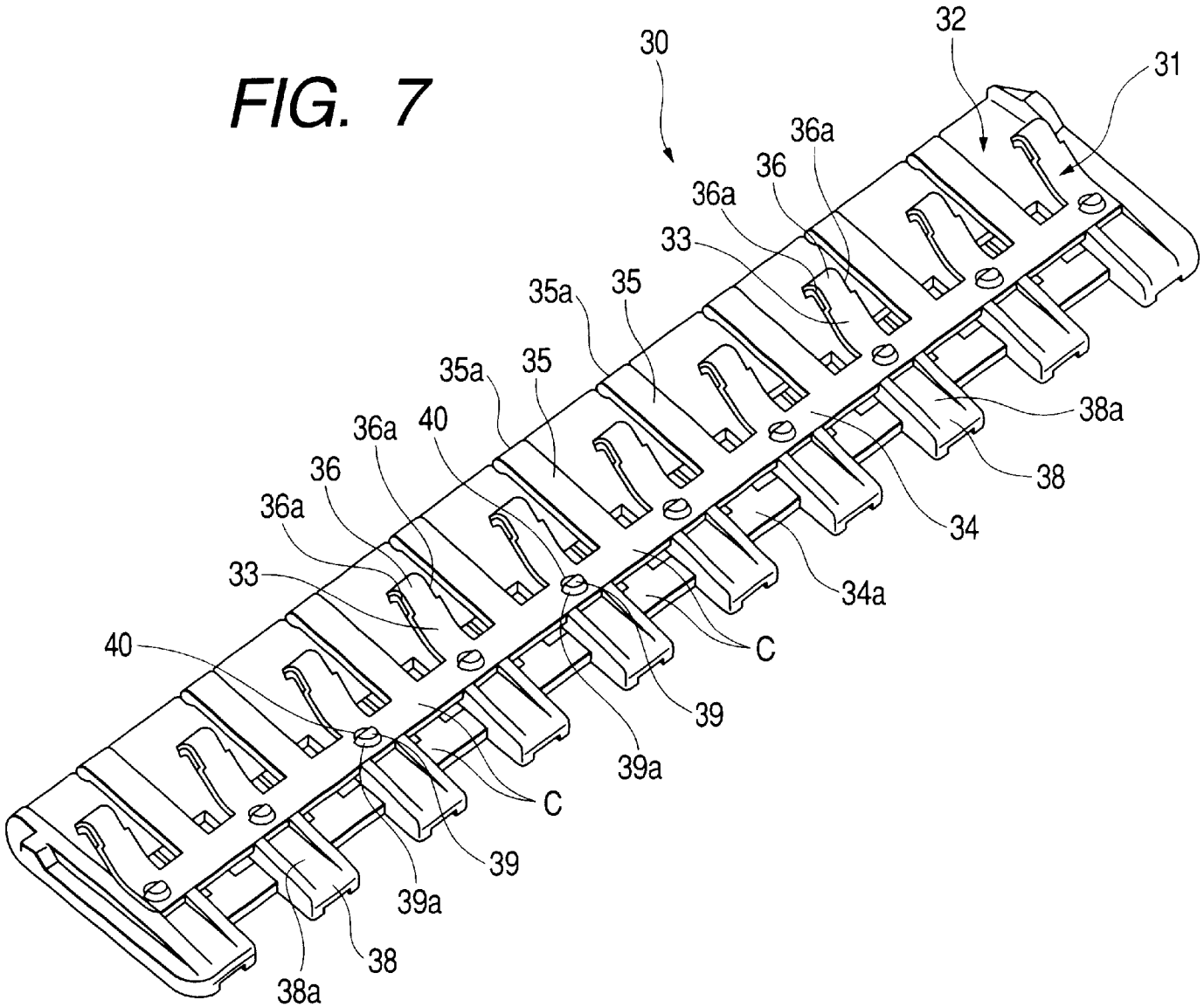
FIG. 7 is an enlarged, perspective view of a circuit forming element used in the joint connector of the invention.
Figure 8:
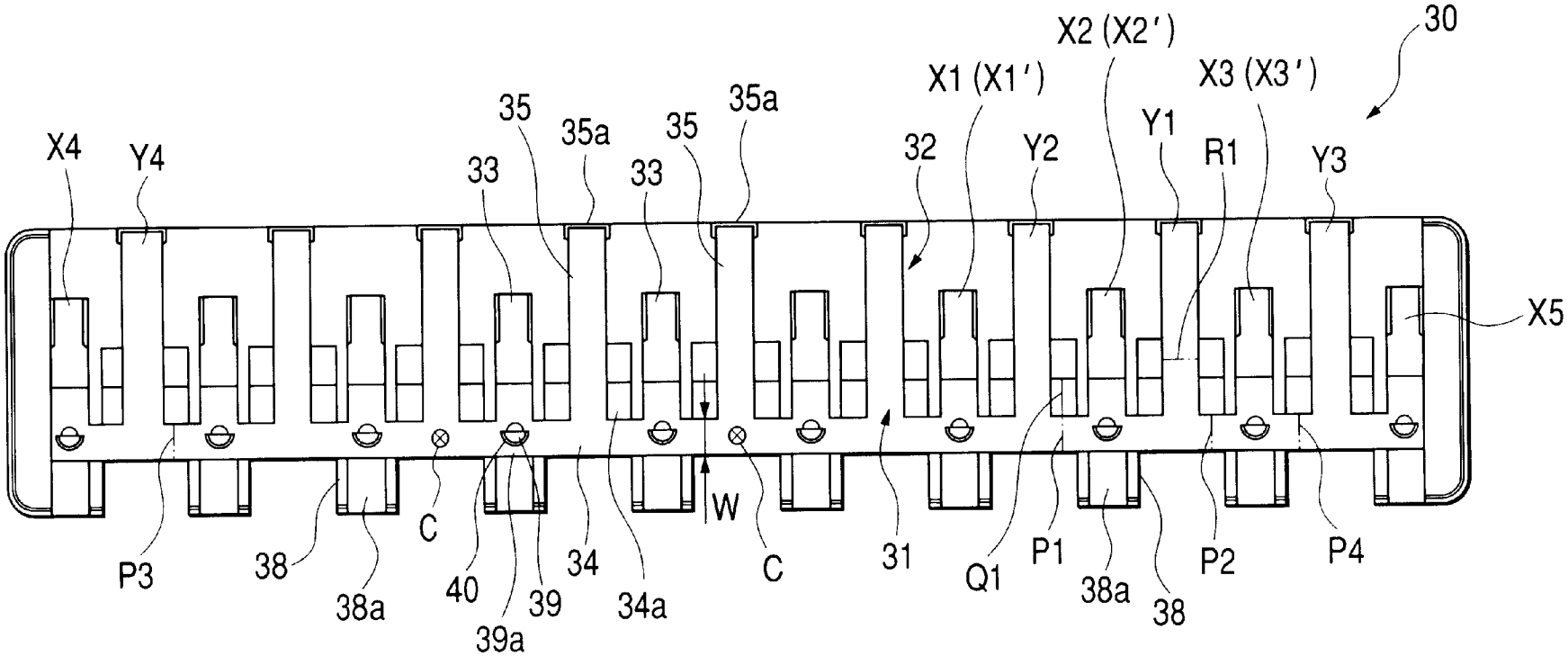
FIG. 8 is an enlarged, plan view of the circuit forming element used in the joint connector of the invention.
Figure 9:
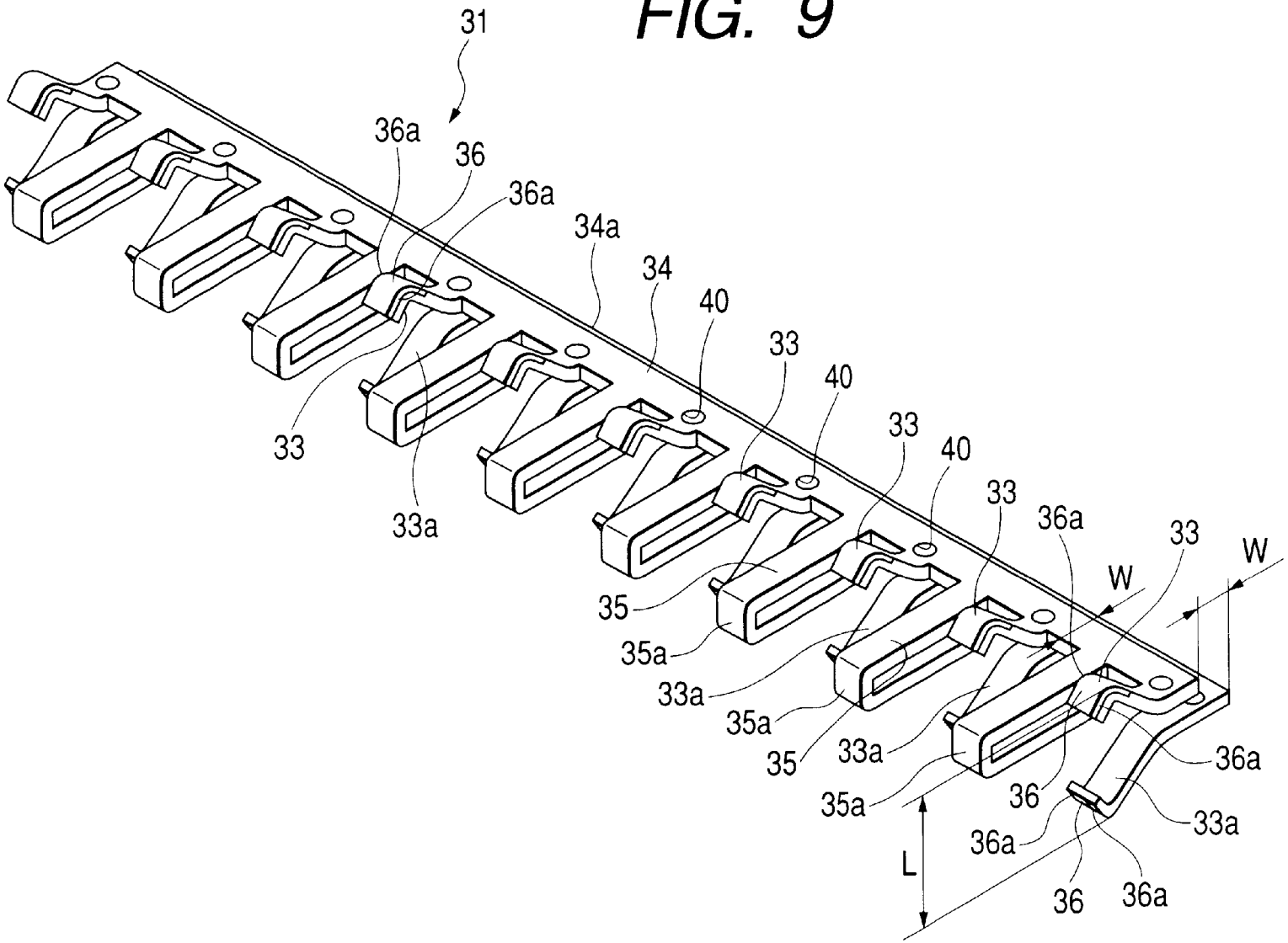
FIG. 9 is an enlarged, perspective view of a bus bar of the circuit forming element used in the joint connector of the invention.
Figure 10:
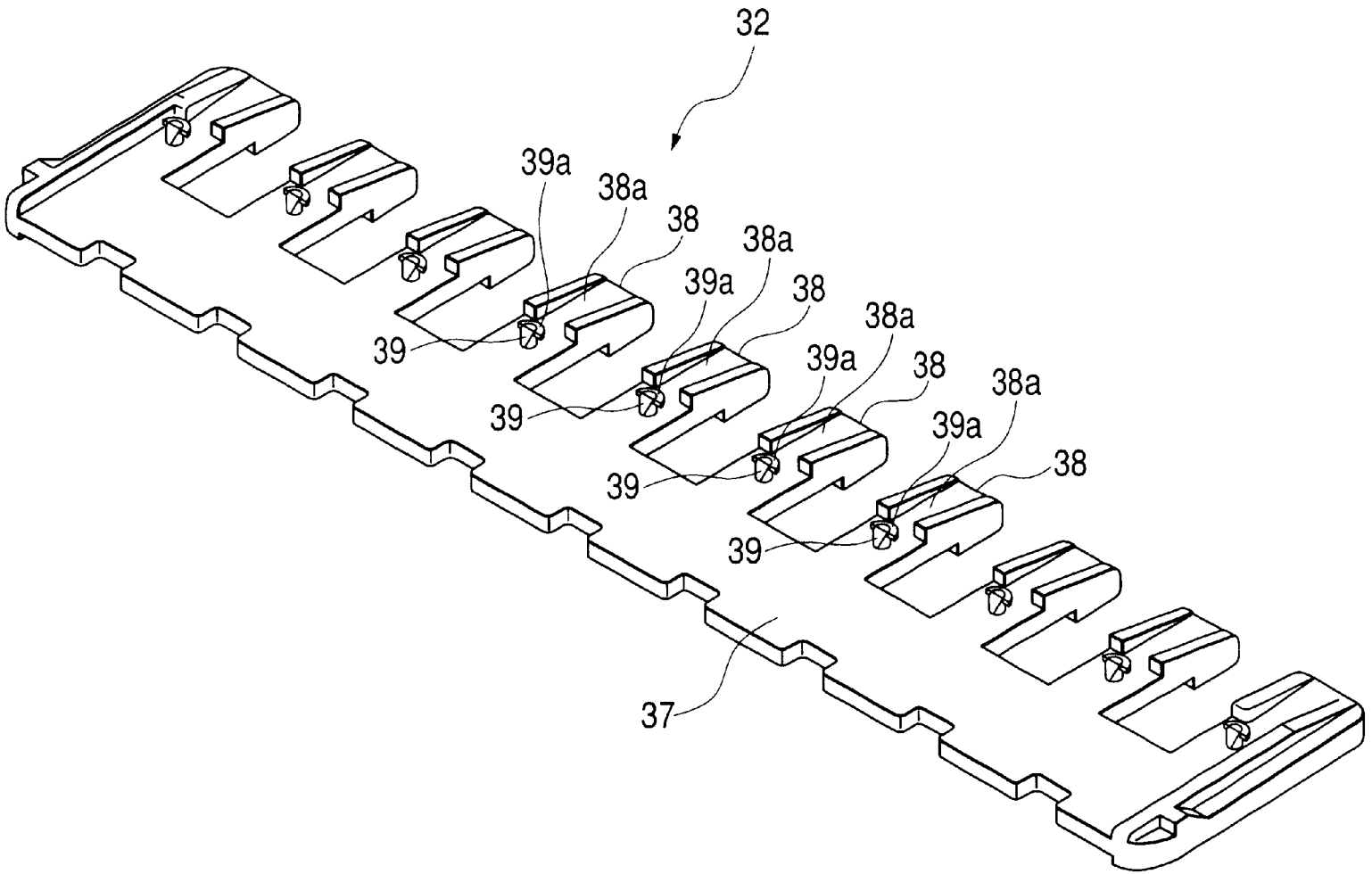
FIG. 10 is a perspective view of a bus bar-fixing member of the circuit forming element used in the joint connector of the invention.

FIGS. 7 to 10 show the circuit forming element 30, and FIG. 7 is a perspective view showing the whole thereof, FIG. 8 is a plan view, FIG. 9 is a perspective view of a bus bar forming the circuit forming element, and FIG. 10 is a perspective view of a bus bar-fixing member forming the circuit forming element.

When the circuit forming element 30 is inserted into the gap δ between the stacked housings 10 as shown in FIG. 4, this circuit forming element 30 functions to electrically connect arbitrarily-selected, opposed terminals 20 of the housings 10, adjoining to each other in the stacking direction, and also to electrically connect arbitrarily-selected, juxtaposed terminals 20 of the same housing 10. As shown in FIGS. 7 and 8, this circuit forming element 30 comprises the bus bar 31, formed of a conductor member such as good electrically-conductive metal, and a holder 32 (serving as the bus bar-fixing member) which is made of an insulative material such as a synthetic resin, and supports this bus bar 31, the bus bar 31 and the holder 32 being integrally coupled together.

As shown in FIG. 9, the bus bar 31 includes terminal contact pieces 33 and 33*a* which can be contacted with the respective opposed terminals 20 of the stacked housings 10 in a paired manner, a pair of connecting base portions 34 and 34*a* one of which connects proximal ends of the terminal contact pieces 33 disposed at the same side while the other connecting base portion connects proximal ends of the terminal contact a paired manner, a pair of connecting base portions 34 and 34*a* pieces 33*a* disposed at the same side, and connecting pieces 35 connecting the pair of connecting base portions 34 and 34*a*.

The pairs of terminal contact pieces 33 and 33*a* correspond in number to the terminals 20 received in each housing 10, and each pair of terminal contact pieces 33 and 33*a* project and are curved in such a manner that the distance L between their outer portions is larger than the distance between the opposed terminals 20 of the stacked housings 10 as shown in FIG. 4. Therefore, the curved outer portions thereof serve as contact portions 36, respectively, which can contact with the respective terminals 20 with a suitable resilient force. Chamfered portions 36*a* are formed respectively at opposite side edges of this contact portion 36 as shown in an enlarged view of a portion A in FIG. 4.

As shown in FIG. 8, each of the pair of connecting base portions 34 and 34*a* is formed into a strip-like shape, and has a predetermined width w, and the two connecting base portions 34 and 34*a* are offset (the offset amount is w) with respect to each other in the forward-rearward direction so that the two connecting base portions 34 and 34*a* will not overlap each other in a plane of projection in a direction of opposing of these portions 34 and 34*a* to each other, that is, in the upward-downward direction (in the drawings).

As shown in FIG. 8, the plurality of connecting pieces 35 are disposed between the terminal contact pieces 33 and 33*a*, and each connecting piece 35 extends from the connecting base portion 34 over an obverse surface of the holder 32, and is bent or turned back at a U-shaped bent portion 35*a* at a front edge of the holder 32, and further extends to the other connecting base portion 34a over the reverse surface of the holder. Therefore, the U-shaped bent portions 35*a* are disposed at the front side of the holder 32, and when the circuit forming element 30 is inserted into the gap δ between the stacked housings 10, these U-shaped bent portions 35*a* are exposed to the fitting portion 100*a* of the joint connector 100.

As shown in FIG. 10, the holder 32 includes a base portion 37 extending in the direction of arrangement of the terminal contact pieces 33 and 33*a*, and a plurality of lance-return regulating portions 38 which extend (like teeth of a comb) from those portions of this base portion 37 corresponding respectively to the terminal contact pieces 33 and 33*a*. When the circuit forming element 30 is inserted into the gap δ between the stacked housings 10 as shown in FIG. 4, this lance-return regulating portion 38 slides under the lance 15 to press this lance 15 in a withdrawal prevention direction, that is, in the upward direction in this figure. In this embodiment, a recess 38*a* for adjusting the amount of lifting of the lance 15 is formed in an upper surface of the lance-return regulating portion 38. However, in so far as the amount of lifting of the lance can be properly set, the provision of this recess 38*a* is not always necessary, and the upper surface of the lance-return regulating portion 38 may be made flat.

Projections 39 are formed respectively on those portions of the obverse surfaces of the lance-return regulating portions 38 at which the connecting base portion 34 is disposed, and also projections 39 are formed respectively on those portions of the reverse surfaces of the lance-return regulating portions 38 at which the connecting base portion 34*a* is disposed. Round holes (openings) 40 are formed respectively through those portions of each connecting base portion 34, 34*a* where the terminal contact pieces 33, 33*a* intersect this connecting base portion 34, 34*a* in a T-shaped manner, that is, these round holes 40 are formed respectively through those portions of the connecting base portion 34, 34*a* disposed adjacent respectively to the proximal ends of the terminal contact pieces 33, 33*a*. These round holes 40 are fitted on the projections 39, respectively, and by doing so, the bus bar 31 and the holder 32 are integrally coupled together.

Figure 11:
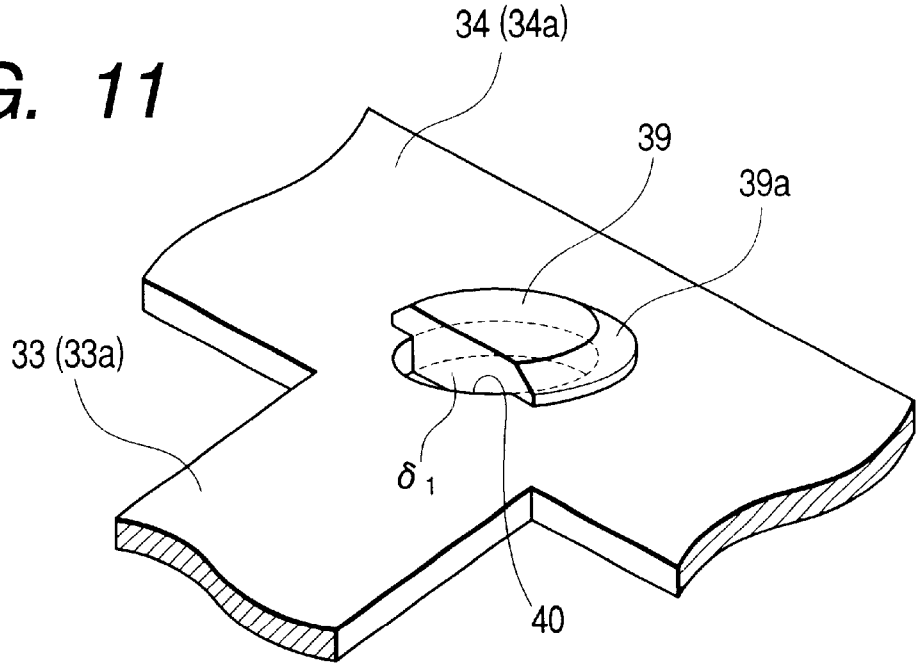
FIG. 11 is an enlarged, perspective view showing those portions of the bus bar and bus bar-fixing member of the circuit forming element (used in the joint connector of the invention) which are connected together.

As shown in FIG. 11 which is an enlarged, perspective view, the projection 39 has a semi-circular transverse cross-section, and a gap δ1 is formed partially between this projection and the inner peripheral surface of the round hole 40, and a retaining flange 39*a* is formed on the distal end of the projection 39. The round hole 40 is fitted on the projection 39 while deforming the flange 39*a* by the inner peripheral surface of this round hole 40.

In the circuit forming element 30 of this construction having the plurality of pairs of the terminal contact pieces 33 and 33*a,* one group of terminal contact pieces 33, disposed at the same side, are electrically connected to one another by the connecting base portion 34 while the other group of terminal contact pieces 33*a,* disposed at the same side, are electrically connected to one another by the connecting base portion 34*a*. The connecting base portions 34 and 34*a* are electrically connected together through the connecting pieces 35, and therefore the terminal contact pieces 33 and 33*a* are all electrically connected together.

In this condition, the connecting base portions 34 and 34*a* and the connecting pieces 35 are cut at suitable portions, and by doing so, the electrically-connecting relation of the plurality of terminal contact pieces 33 and 33*a* can be freely set, and arbitrary circuits can be formed, using the selected ones of the terminals 20 received in the stacked housings 10. At this time, each cut portion is formed in the vicinity of a connecting portion C where the connecting piece 35 merges into the connecting base portion 34, 34*a* in a T-shaped manner.

One example of arbitrary circuit constructions, formed by the circuit forming element 30, is shown in FIG. 8. In this case, cut portions of the connecting base portion 34 (one of the connecting base portions 34 and 34*a*) are designated by PI, P2 in this figure, cut portions of the other connecting base portion 34*a* are designated by Q1, Q2 . . . , cut portions of the connecting pieces 35 are designated by R1, R2 , the specified terminal contact pieces 33 are designated by X1, X2 . . . the terminal contact pieces 33*a* (not shown), opposed respectively to these portions X1, X2 . . . , are designated by X'1, X'2 . . . , and the specified connecting pieces 35 are designated by Y1, Y2 . . . .

Namely, when the connecting base portions 34 and 34*a* are cut respectively at the portions P1 and Q1 between the terminal contact pieces X1 and X2 as shown in FIG. 8, the terminal contact piece X1, X1' is electrically disconnected from the terminal contact piece X2, X2'. And, when the connecting base portion is cut at the portions P1 and P2, and the connecting piece Y1 is cut at the portion R1, the terminal contact pieces X1 and X3 are electrically connected together through the connecting pieces Y2 and Y3, and therefore there can be obtained a skip connection in which the terminal contact piece X2 is skipped over. In this skip connection, not only one terminal contact piece 33 is skipped over, but also various forms can be obtained. For example, when the connecting base portion is cut at opposite end portions P3 and P4, only the terminal contact pieces X4 and X5, disposed respectively at the opposite ends, are electrically connected together through the connecting pieces Y3 and Y4. For connecting the opposite-end terminal contact pieces X4 and X5 in a skipped manner, all the connecting pieces 35 except those Y3 and Y4 are cut.

By setting the combination of the cut portions of the connecting base portions 34 and 34*a* and the connecting pieces 35 in various ways other than the above construction, arbitrarily-selected, opposed terminal contact pieces 33 and 33*a* can be electrically connected together, and also arbitrarily-selected terminal contact pieces 33 (and 33*a*), disposed at the same side, can be electrically connected together.

In the joint connector 100 of this embodiment having the above construction, the housings 10, each having the plurality of terminals 20 received respectively in the juxtaposed terminal accommodating portions 11, are stacked together, and the circuit forming element 30 is inserted into the gap δ between the stacked housings 10.

This circuit forming element 30 is formed by the bus bar 31 and the holder 32 which are integrally coupled to each other, and the bus bar 31 includes the pairs of terminal contact pieces 33 and 33*a,* the pair of connecting base portions 34 and 34*a,* and the connecting pieces 35. With this circuit forming element 30, the terminals 20 of the housings 10, adjoining to each other in the stacking direction, as well as the terminals 20 of the same housing 10, can be connected, and besides arbitrary ones of the terminals 20 can be selected and connected in accordance with the circuit structure of this circuit forming element 30.

Therefore, in the joint connector 100, with the simple construction in which the circuit forming element 30, separate from the terminals 20, is inserted into the gap δ, the terminals 20, disposed in a stacked manner, can be easily connected, and besides the desired circuit can be easily obtained by the circuit structure of the circuit forming element 30, and a wide variety of circuits can be formed.

The fitting portion 100*a* is provided at the front side of the joint connector 100, and the mating connector 200 is fitted on this fitting portion 100*a*. When the mating connector 200 is thus fitted, the mating terminals 220 are inserted into the respective insertion ports 11a in the housings 10, and are connected to the terminals 20, respectively. Therefore, arbitrary circuits are formed by the plurality of terminals 20 received in the stacked housings 10, and then the mating connector 200 is fitted on the fitting portion 100*a* of the joint connector 100, and by doing so, the mating terminals 220 of the mating connector 200, forming other wiring circuits, can be easily connected to the terminals 20, respectively.

In this embodiment, when the housings 10 are stacked together, the retaining projections 14, formed on the upper housing 10, are engaged respectively in the retaining recesses 20*a* of the terminals 20 received respectively in the terminal accommodating portions 11 of the lower housing 10, thereby preventing the withdrawal of these terminals 20, as shown in FIG. 4.

In addition to the retaining projections 14, the lance 15 is provided at each terminal accommodating portion 11, and this lance is engaged with the retaining portion 20*b* of the terminal 20, thus achieving the double-retaining structure.

This engaged condition of the lance 15 is maintained by the lance-return regulating portion 38 (formed on the holder 32 of the circuit forming element 30) pressed against this lance, and therefore the restoration of the lance 15 and hence the cancellation of its engagement with the terminal 20 are prevented, and the withdrawal of the terminal 20 is prevented more positively.

In this embodiment, the lower one of the stacked housings 10 is the integrated-type housing 10A while the upper one is the split-type housing 10B. This split-type housing 10B can be divided into the sub-housings through the engaging portion 16, and the plurality of terminals 20, received in this housing, can be divided in the suitable ratio. Therefore, in the case where groups of wires for connection to the terminals are installed from different directions, the groups (or bundles) of wires are beforehand connected respectively to the separate housings 10B*a* and 10B*b* corresponding respectively to these wire groups, and the separate housings 10B*a* and 10B*b,* when stacked on the integrated-type housing 10A, are combined together into a unitary form, and by doing so, the wire-connecting operation can be effected easily.

The engaging portion 16 serves as the positioning device by which the arrangement pitch of the terminals 20 in the split-type housing 10B coincides with the arrangement pitch of the terminals 20 in the integrated-type housing 10A. Therefore, except at the engaging portion 16, the terminals 20, received in the housing 1A, are disposed respectively in registry with the terminals 20 in the housing 10B (laid on the housing 10A) in the stacking direction, and therefore the combination of the circuits (formed by inserting the circuit forming element 30) in the stacking direction can be made clear, so that the circuit formation can be properly effected.

In the circuit forming element 30, the bus bar 31, formed of a conductor member such as good electrically-conductive metal, is supported on the holder 32, and therefore the bus bar 31 can be held in contact with the terminals 20 without the need for excessively increasing the strength of this bus bar 31, and therefore the incomplete contact of the circuit can be prevented.

The bus bar 31 has the pairs of opposed upper and lower terminal contact pieces 33 and 33*a,* and the upper terminal contact pieces 33 contact the upper terminals 20 of the stacked housings 10, respectively, while the lower terminal contact pieces 33*a* contact the lower terminals 20, respectively, and the terminal contact pieces 33, disposed at the same side, are connected by the connecting base portion 34 while the terminal contact pieces 33*a,* disposed at the same side, are connected by the connecting base portion 34*a,* and the pair of connecting base portions 34 and 34*a* are connected by the connecting pieces 35. Therefore, by cutting the connecting base portions 34 and 34*a* and the connecting pieces 35 at suitable portions, a variety of circuits, including a skip connection, can be formed, using selected ones of the opposed upper and lower terminals of the stacked housings 10 and selected ones of the juxtaposed terminals 20 in each housing.

In this case, each of the cut portions of the connecting base portions 34 and 34*a* and connecting pieces 35 is provided in the vicinity of the corresponding T-shaped connecting portion C where the connecting piece 35 and the connecting base portion 34, 34*a* intersect each other. Therefore, these cut portions are thus provided in a concentrated manner, so that the electrically-connecting relation can be easily controlled, and besides cutting blades (not shown) for the connecting base portions 34 and 34*a* and the connecting pieces 35 can be arranged in a concentrated manner, so that the compact arrangement can be achieved.

The pair of connecting base portions 34 and 34*a* are offset with respect to each other so that the two connecting base portions 34 and 34*a* will not overlap each other in a plane of projection in the direction of opposing of these portions 34 and 34*a* to each other, that is, in the cutting direction, and therefore when cutting the suitable portions of the connecting base portions 34 and 34*a,* these connecting base portions 34 and 34*a* can be easily cut separately from each other, and this cutting operation can be carried out easily.

The terminal contact pieces 33 and 33*a* are resiliently contacted with the terminals 20, and therefore are electrically connected thereto. The terminal contact pieces 33 and 33*a* are integrally attached at their proximal ends to the holder 32 through the respective projections 39 and round holes 40, and therefore each of the terminal contact pieces 33 and 33*a* can secure the force of contact with the terminal 20, effectively utilizing its spring force, so that the incomplete contact thereof can be prevented.

The chamfered portions 36*a* are formed respectively at the opposite side edges of that portion of the terminal contact piece 33, 33*a* which can contact the terminal 20, and therefore the terminal 20 is prevented from being damaged by the side edges of the contact portion 36 of the terminal contact piece 33, 33*a*.

The projection 39 is fitted in the round hole 40 in such a manner that the gap δ1 is formed partially between this projection 39 and the inner peripheral surface of the round hole 40. Therefore, when the flange 39*a* of the projection 39 is deformed upon fitting of the projection 39 into the round hole 40, such a deformed portion escapes to the gap δ1, and therefore the amount of cutting of the flange 39*a* by the inner peripheral surface of the round hole 40 can be decreased, and the force of connection between the round hole 40 and the projection 39, which are finally fixed together by the flange 39*a,* can be increased.

The U-shaped bent portions 35*a* of the connecting pieces 35 of the bus bar 31 are disposed at the front edge of the holder 32, and these U-shaped bent portions 35*a* are exposed to the fitting portion 100*a* of the joint connector 100. Therefore, a measuring terminal of a tester (not shown) can be easily brought into contact with these exposed portions, and therefore the conducting relation of the bus bar 31 can be examined easily and positively. And besides, the U-shaped bent portions 35*a* are exposed to the fitting portion 100*a* on which the mating connector 200 is fitted, and therefore when the mating connector 200 is fitted, the exposed portions can be concealed.

In this embodiment, although the lower one of the stacked housings 10 is the integrated-type housing 10A while the upper one is the split-type housing 10B, all of the housings may be the integrated-type housings 10A or the split-type housings 10B.

Figure 12:
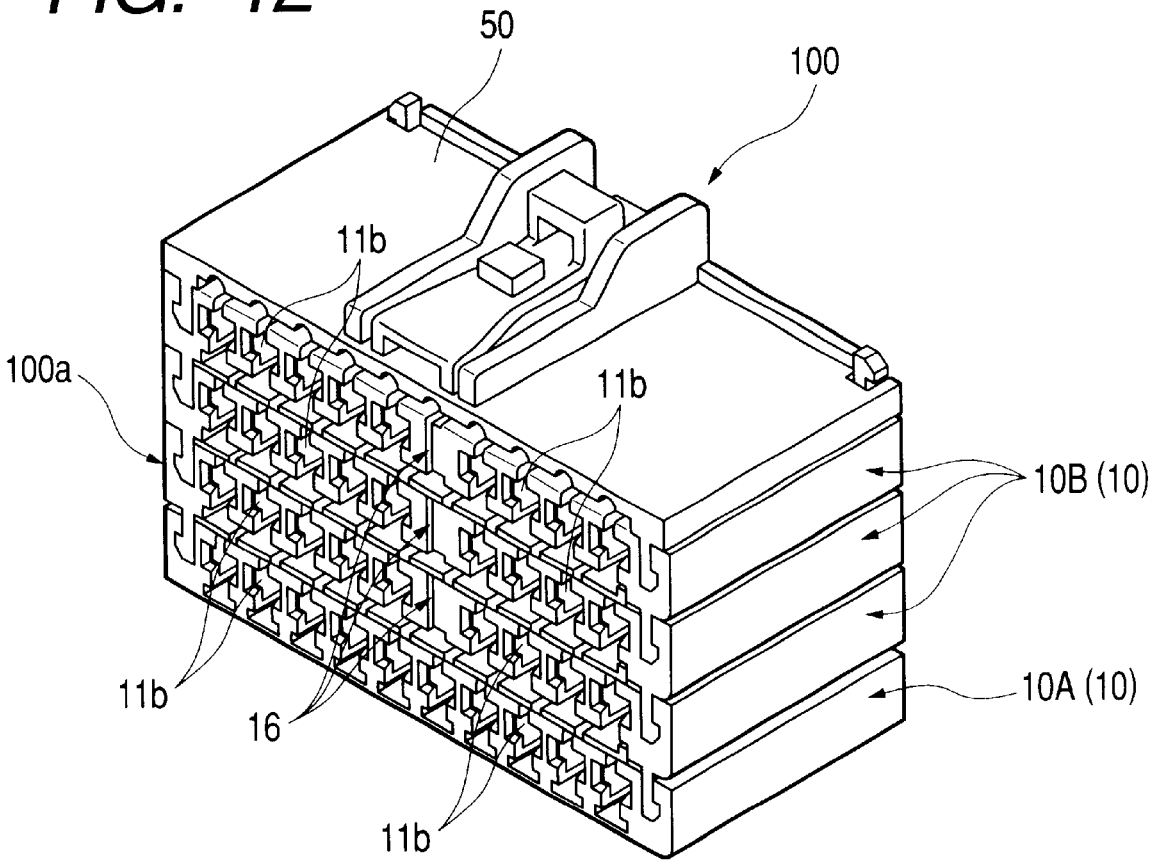
FIG. 12 is a perspective view of another (second) embodiment of a joint connector of the invention.

Although the two housings 10 are vertically stacked one upon another, three or more housings can be stacked one upon another as shown in FIG. 12 (In this embodiment, four housings are stacked together).

FIGS. 13 to 16 show another embodiment, and those constituent portions, identical to those of the preceding embodiment, will be designated by identical reference numerals, respectively, and repeated description thereof will be omitted. Namely, this embodiment differs in that a circuit forming element 30 is inserted into stacked housings 10 from a side thereof.

Figure 13:
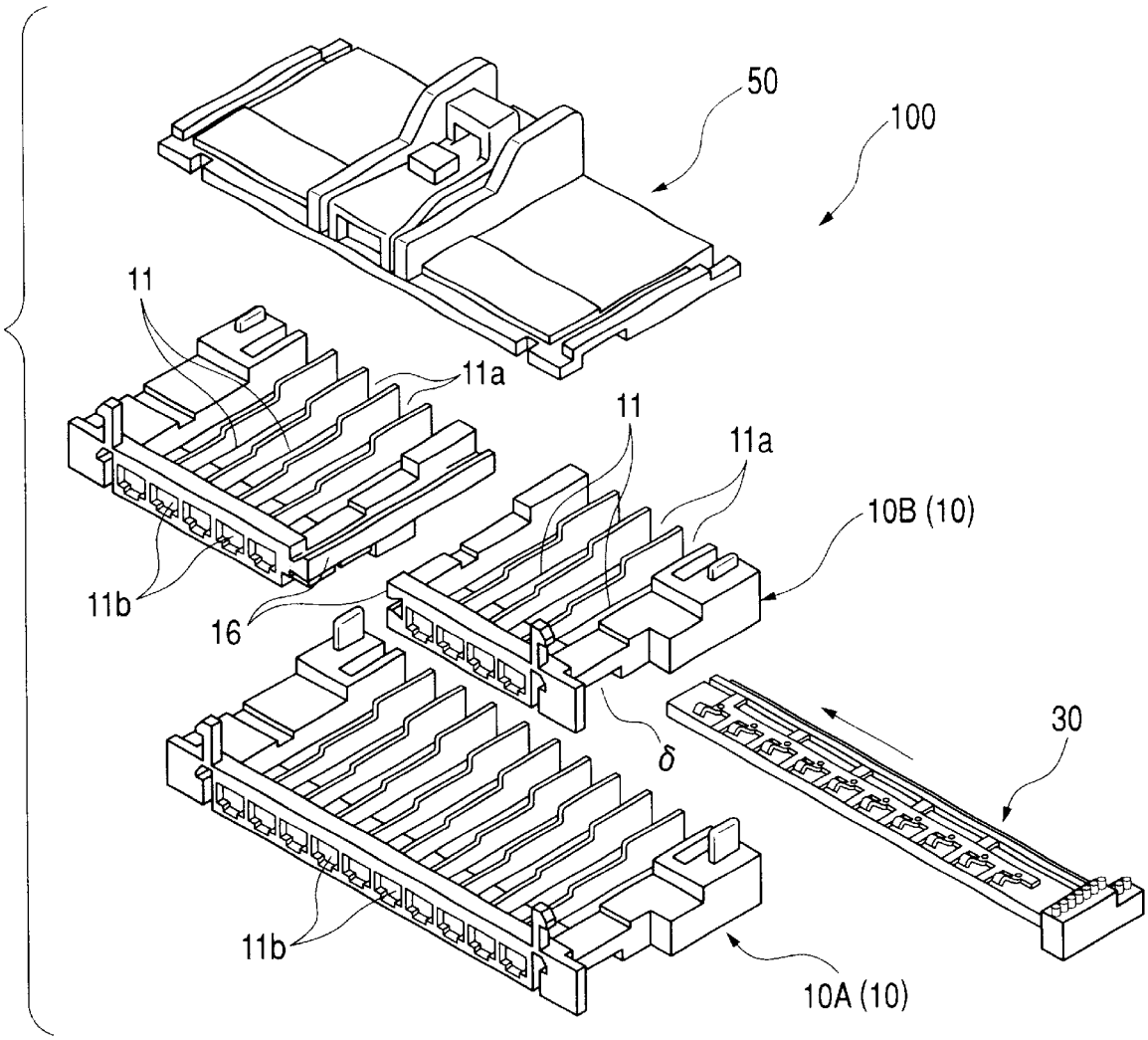
FIG. 13 is an exploded, perspective view of the second embodiment of the joint connector of the invention.
Figure 14:
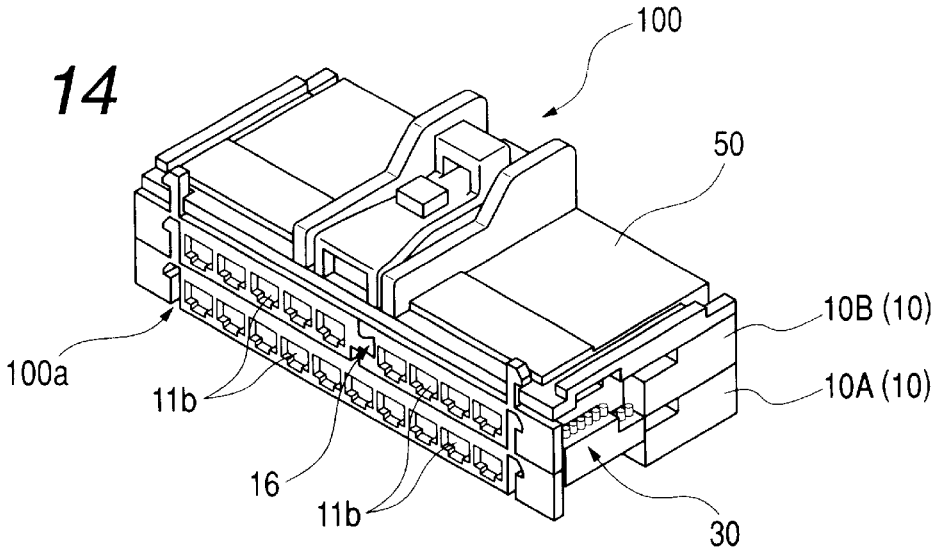
FIG. 14 is a perspective view of the second embodiment of the joint connector of the invention.
Figure 15:
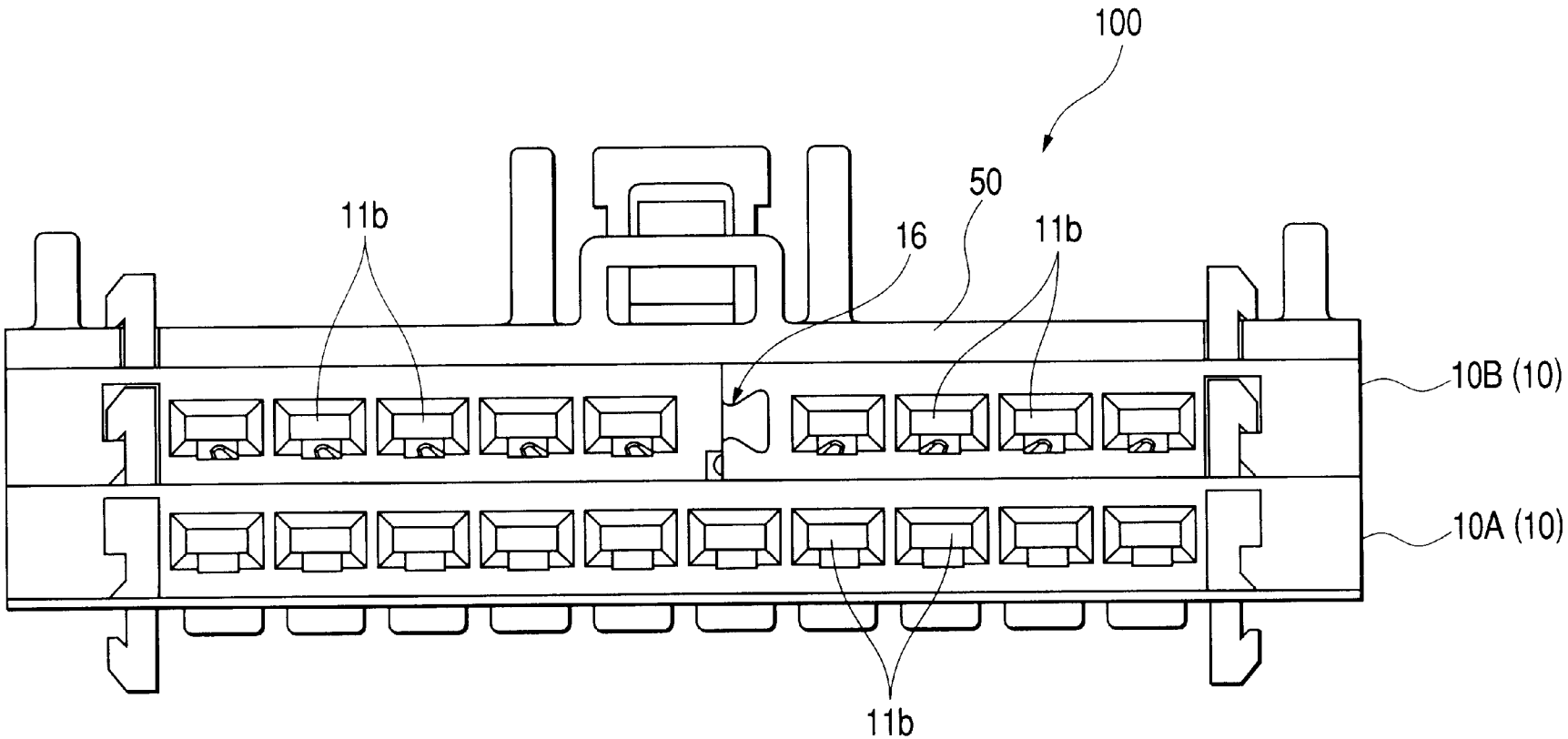
FIG. 15 is an enlarged, front-elevational view of the second embodiment of the joint connector of the invention.
Figure 16:
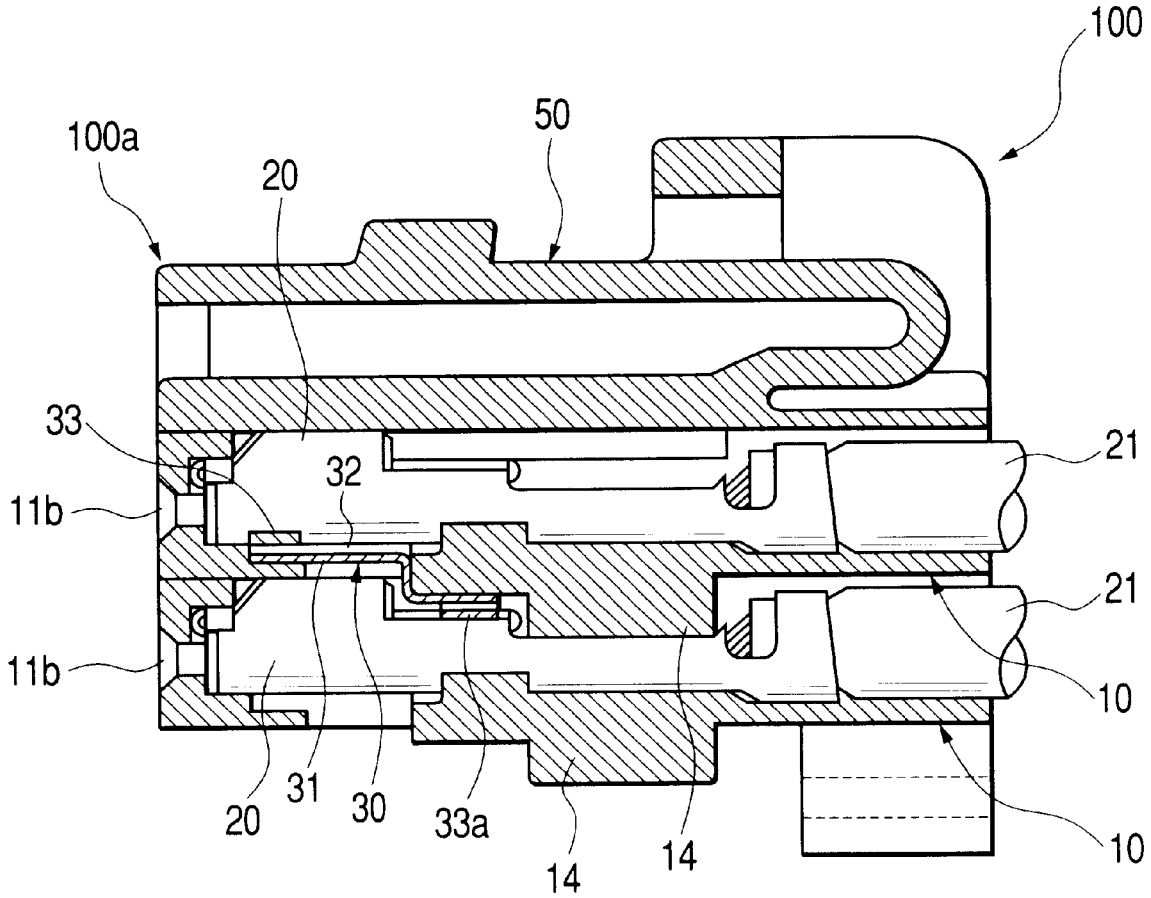
FIG. 16 is a vertical cross-sectional view of the second embodiment of the joint connector of the invention.
Figure 17:
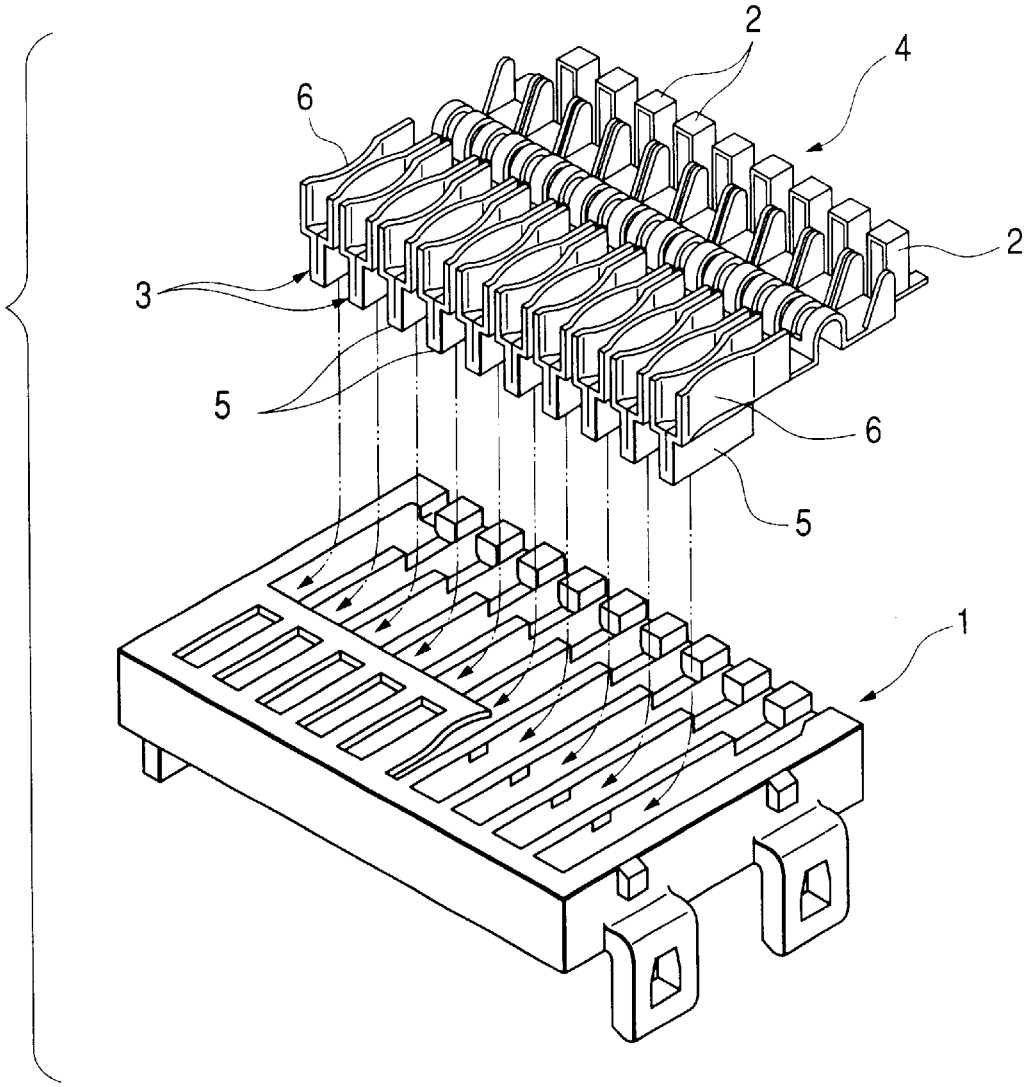
FIG. 17 is an exploded, perspective view of a conventional joint connector.
Figure 18:
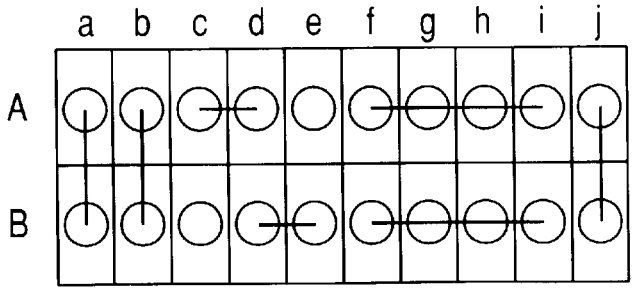
FIG. 18 is a diagram explanatory of circuit patterns obtained by the conventional joint connector.

FIG. 13 is an exploded, perspective view, and when the upper housing 10A and the lower housing 10B are stacked together, a gap δ for inserting the circuit forming element 30 therein is formed in one side of the two stacked housings 10A and 10B. Even in this case where the circuit forming element 30 is of the side-inserting type, insertion ports 11*b* for mating terminals are formed in a front surface of a joint connector 100 as shown in FIG. 15.

When the circuit forming element 30 is inserted into the gap δ, terminal contact pieces 33, formed on an obverse surface of a bus bar 31, are contacted with upper terminals 20, respectively, while terminal contact pieces 33*a,* formed on a reverse surface of the bus bar 31 in corresponding relation to the terminal contact pieces 33, are contacted respectively with lower terminals 20 opposed respectively to the upper terminals 20. Of course, the pairs of terminal contact pieces 33 and 33*a* are connected together through connecting base portions and connecting pieces (not shown) so that arbitrary circuits can be formed.

In the joint connector of the invention, by inserting the circuit forming element into the gap between the stacked housings, arbitrarily-selected ones of the terminals of the adjacent housings, adjoining to each other in the stacking direction, can be connected by this circuit forming element, and also the arbitrarily-selected ones of the terminals in the same housing can be connected by this circuit forming element. Therefore, with the simple construction in which the circuit forming element, separate from the terminals, is inserted into the gap, the terminals, disposed in a stacked manner, can be easily connected, and besides the desired circuit can be easily obtained by the circuit structure of the separate circuit forming element, and a wide variety of circuits can be formed.

In the joint connector of the invention, the housing is divided into the sub-housings, releasably connected together, so that the plurality of terminals, received in the housing, can be divided in the predetermined ratio. Therefore, groups of wires for connection to the terminals are installed from different directions, the wire-connecting operation can be effected easily.

In the joint connector of the invention, the housing includes the fitting portion for fitting into a mating housing, and insertion ports, through which mating terminals can be connected respectively to the terminals upon fitting of the mating connector into the fitting portion, are formed in the fitting portion. Therefore, the mating terminals of the mating connector, forming other wiring circuits, can be easily connected to the terminals, respectively.

In the joint connector of the invention, the engaging portion of the divided housing serves as the positioning device by which the arrangement pitch of the terminals in the divided housing coincides with the arrangement pitch of the terminals in the housing adjoining to this divided housing in the stacking direction. Therefore, the combination of the circuits (formed by inserting the circuit forming element) in the stacking direction can be made clear, so that the circuit formation can be properly effected.

In the joint connector of the invention, the circuit forming element includes the bus bar, comprising a conductor member, and the bus bar-fixing member, which comprises an insulating member, and supports the bus bar, and the bus bar and the bus bar-fixing member are integrally coupled together. Therefore, the bus bar can be held in contact with the terminals, and the incomplete contact of the circuit can be prevented.

In the joint connector of the invention, the bus bar includes the plurality of pairs of terminal contact pieces, each pair of which can be contacted respectively with the corresponding opposed terminals of the adjacent housings adjoining to each other in the stacking direction, the pair of connecting base portions one of which integrally connects the proximal ends of the terminal contact pieces disposed at one side while the other connecting base portion integrally connects the proximal ends of the terminal contact pieces disposed at the other side, and the connecting pieces connecting the pair of connecting base portions. Therefore, one or both of the pair of connecting base portions are cut at suitable portions, and suitable ones of the connecting pieces are cut, and by doing so, a wide variety of circuits, including a skip connection, can be formed.

In the joint connector of the invention, the pair of connecting base portions are offset with respect to each other so that the two connecting base portions will not overlap each other in a plane of projection in a direction of opposing of the connecting base portions to each other. Therefore, when cutting the connecting base portions by inserting cutting blades respectively in their opposing directions, these connecting base portions can be easily cut separately from each other, and this cutting operation can be effected easily.

In the joint connector of the invention, the proximal ends of the terminal contact pieces are integrally attached to the bus bar-fixing member. Therefore, each of the terminal contact pieces can secure the force of contact with the terminal, effectively utilizing its spring force, so that the incomplete contact thereof can be prevented.

In the joint connector of the invention, each of the flanged projections on the bus bar-fixing member is fitted in the corresponding opening in the bus bar in such a manner that a gap is formed partially between the projection and the inner peripheral surface of the opening, and by doing so the bus bar and the bus bar-fixing member are coupled together. Therefore, when the flange of the projection is deformed upon fitting of the projection into the opening, such a deformed portion escapes to the gap, and therefore the amount of cutting of the flange by the inner peripheral surface of the opening can be decreased, and the force of connection between the opening and the projection, which are finally fixed together, can be increased.

In the joint connector of the invention, the cutting portions, at which the connecting base portion and the connecting piece can be selectively cut, respectively, are provided in the vicinity of each of connecting portions of the bus bar where the connecting bas portion and the connecting piece are connected together. Therefore, these cut portions are provided in a concentrated manner, so that the electrically-connecting relation can be easily controlled, and besides the cutting blades can be arranged in a concentrated manner, so that the compact arrangement can be achieved.

In the joint connector of the invention, the retaining projections, formed on the housing, are inserted respectively into the terminal accommodating portions of the housing adjoining to the first-mentioned housing in stacked relation, and each of the retaining projections engages the terminal, received in the terminal accommodating portion, in a direction to prevent the withdrawal of the terminal, and therefore the withdrawal of the terminal can be prevented more positively.

In the joint connector of the invention, the bus bar-fixing member has the lance-return regulating portions each for pressing the corresponding lance (engaged with the terminal in the withdrawal prevention direction) in the withdrawal prevention direction. Therefore, when the circuit forming element is inserted into the gap between the stacked housings, the restoration of the lance and hence the cancellation of its engagement with the terminal are prevented, thereby preventing the withdrawal of the terminal.

In the joint connector of the invention, the chamfered portions are formed respectively at the opposite side edges of that portion of the terminal contact piece which can contact the terminal. Therefore, the terminal is prevented from being damaged by the side edges of the contact portion of the terminal contact piece.

In the joint connector of the invention, the U-shaped bent portions of the connecting pieces are exposed to the fitting portion which can fit in the mating connector. Therefore, the electrically-connecting relation of the bus bar can be easily and positively examined by a tester.

What is claimed is:

1. A joint connector comprising:

at least two housings which are stacked together with a predetermined gap formed therebetween, each of said housings having a plurality of juxtaposed terminals received therein; and a circuit forming element provided in said gap, by which arbitrary ones of said terminals are selectively connected with others of said terminal in the housings adjoining to each other as well as in the same housing, wherein one of said housings is divided into at least two sub-housings, each of which is releasably engaged with another sub-housing, and said sub-housings respectively accommodate a predetermined number of said terminals, so that said plurality of terminals in said one housing are divided with a predetermined ratio.

2. A joint connector according to claim 1, further comprising insertion ports formed on a fitting portion of said housing, wherein mating terminals in a mated connector are connected respectively to said terminals through said insertion ports when said mating connector is fitted into said fitting portion.

3. A joint connector according to claim 1, wherein an engaging portion formed on one of said sub-housings serves as a positioning device by which arrangement pitches of said terminals between said sub-housings are coincided in an engaging direction of said sub-housing.

4. A joint connector according to claim 1, wherein said circuit forming element includes a bus bar provided with a conductor member, and a bus bar-fixing member provided with an insulating member, and said bus bar and said bus bar-fixing member are integrally coupled with each other.

5. A joint connector according to claim 4, wherein an opening is formed on said bus bar, and a projection having a flange is formed on said bus bar-fixing member, and said projection is fitted in said opening in such a manner that a gap is formed partially between said projection and an inner peripheral surface of said opening, and said bus bar and said bus bar-fixing member are coupled together through said opening and said projection.

6. A joint connector according to claim 4, wherein said bus bar includes a plurality of pairs of terminal contact pieces, each pair of which are brought into contact respectively with the terminals opposing with each other provided in the housings adjoining to each other in the stacking direction, a pair of connecting base portions one of which integrally connects proximal ends of said terminal contact pieces disposed at one side while the other connecting base portion integrally connects proximal ends of said terminal contact pieces disposed at the other side, and connecting pieces connecting said pair of connecting base portions.

7. A joint connector according to claim 6, wherein said pair of connecting base portions are offset with respect to each other so that the two connecting base portions do not overlap each other in a plane of projection in a direction of opposing of said connecting base portions to each other.

8. A joint connector according to claim 6, wherein the proximal ends of said terminal contact pieces are integrally attached to said bus bar-fixing member.

9. A joint connector according to claim 6, wherein cutting portions are selectively formed on said bus bar in the vicinity of portions where said connecting base portion and said connecting piece are connected together.

10. A joint connector according to claim 6, wherein a chamfered portion is formed at an opposite side edge of said terminal contact piece brought into contact with the terminal.

11. A joint connector according to claim 6, wherein said connecting piece has a U-shaped bent portion turned back in a U-shaped manner at a side edge of said bus bar-fixing member, and said U-shaped bent portion is exposed to a fitting portion fitted into a mating connector.

12. A joint connector according to claim 1, wherein a retaining projection is formed on one of said housings, said retaining projection being inserted into a terminal accommodating portion formed on another of the housing adjoining to said one housing in stacked relation, and said retaining projection retain the terminal received in said terminal accommodating portion in a direction to prevent the withdrawal of the terminal.

13. A joint connector according to claim 11, wherein a lance for engaging the terminal in a direction to prevent the withdrawal thereof is provided in said terminal accommodating portion of said housing, and said bus bar-fixing member has a lance-return regulating portion pressing the lance in a withdrawal prevention direction.

14. A joint connector comprising:

at least two housings which are stacked together with a predetermined gap formed therebetween, each of said housings having a plurality of juxtaposed terminals received therein; and a circuit forming element provided in said gap, by which arbitrary ones of said terminals are selectively connected with others of said terminal in the housings adjoining to each other as well as in the same housing, wherein said circuit forming element includes a bus bar provided with a conductor member, and a bus bar-fixing member provided with an insulating member, and said bus bar and said bus bar-fixing member are integrally coupled with each other.

15. A joint connector comprising:

at least two housings which are stacked together with a predetermined gap formed therebetween, each of said housings having a plurality of juxtaposed terminals received therein; and a circuit forming element provided in said gap, by which arbitrary ones of said terminals are selectively connected with others of said terminal in the housings adjoining to each other as well as in the same housing, wherein a retaining projection is formed on one of said housings, said retaining projection being inserted into a terminal accommodating portion formed on another of the housing adjoining to said one housing in stacked relation, and said retaining projection retain the terminal received in said terminal accommodating portion in a direction to prevent the withdrawal of the terminal.

* * * * *